US006017284A

United States Patent [19]

Giles

[11] Patent Number: 6,017,284

[45] Date of Patent: Jan. 25, 2000

[54] ARCHERY ARROW SHAFT WITH REDUCED DIAMETER REARWARD END FOR NOCK MOUNTING

[75] Inventor: Kenny R. Giles, West Valley City, Utah

[73] Assignee: Jas. D. Easton, Inc., Van Nuys, Calif.

[21] Appl. No.: 09/164,868

[22] Filed: Oct. 1, 1998

[51] Int. Cl.[7] ..... F42B 6/04

[52] U.S. Cl. ..... 473/578; 473/586

[58] Field of Search ..... 473/578, 586, 473/FOR 216, FOR 223

[56] References Cited

U.S. PATENT DOCUMENTS

| | | | |
|---|---|---|---|
| 2,288,562 | 6/1942 | Birkhofer et al. | 473/586 |
| 2,499,044 | 2/1950 | Wagg et al. | 473/578 |
| 5,290,044 | 3/1994 | Easton et al. | 473/578 |
| 5,306,019 | 4/1994 | Guest et al. | 473/578 |
| 5,465,979 | 11/1995 | Buhler | 473/578 |
| 5,547,200 | 8/1996 | Rangel | 473/578 |

FOREIGN PATENT DOCUMENTS

| | | |
|---|---|---|
| 644226 | 10/1950 | United Kingdom . |
| 1590954 | 6/1981 | United Kingdom . |
| 2064967 | 6/1981 | United Kingdom . |

*Primary Examiner*—John A. Ricci
*Attorney, Agent, or Firm*—Mallinckrodt & Mallinckrodt

[57] ABSTRACT

A hollow archery arrow shaft has a rearward end portion which is reduced in inside diameter to frictionally receive and hold the mounting shank of a standard nock. This configuration eliminates the need for a bushing in the rearward end of the arrow shaft for accepting the mounting shank of the nock. Reduced arrow weight and better nock positioning and alignment results in faster and more accurate arrow flight. In aluminum arrows, the reduced diameter portion can be formed by swaging the end portion of the arrow shaft to the smaller diameter.

14 Claims, 1 Drawing Sheet

ARCHERY ARROW SHAFT WITH REDUCED DIAMETER REARWARD END FOR NOCK MOUNTING

BACKGROUND OF THE INVENTION

1. Field

The invention is in the field of hollow archery arrow shafts and of mounting nocks to the rearward end of hollow archery arrow shafts.

2. State of the Art

Hollow archery arrow shafts are common and may be made of various materials such as aluminum, carbon, or a combination of aluminum and carbon. Aluminum archery arrow shafts generally are made of thin walled aluminum tubing cut to desired length. Aluminum-carbon shafts use such tubing as the support over which the carbon is placed. An arrow point is attached to the forward end of the shaft and a nock is attached to the rearward end of the shaft. The aluminum tubing used for archery arrow shafts comes in a variety of diameters which provide arrow shafts of various combinations of characteristics such as stiffness, weight, etc.

Traditionally, the rearward ends of the aluminum arrow shafts were swaged to a point and a plastic nock, having a tapered indentation to accept the swaged rearward point of the arrow shaft was glued to the rearward end of the shaft.

More recently with aluminum shafts, aluminum-carbon shafts, and with some carbon shafts, a standard size nock has been produced with a forwardly extending shank adapted for tight friction fit within a bushing secured in the rearward end of the arrow shaft. This allows the nock to be rotated for fine adjustment in alignment with the arrow fletching and allows relatively easy removal and replacement of a nock if it becomes damaged. Such an arrangement is shown in U.S. Pat. No. 5,067,731 to Bickel. Each different diameter arrow shaft requires a different bushing which fits into the selected shaft and provides a standard size bore therein to accept the standard size nock shank.

While a shank system such as shown by the Bickel patent provides the advantage of easy adjustability of the nock and replacement of the nock, and provides the advantage that a standard nock can be used on any diameter archery arrow shaft (the size of the bushing is different for each size shaft), a supply of different bushings is required for each different size shaft and the bushing adds extra weight to the rearward end of the arrow. Further, the bushing needs to be assembled into the arrow shaft which involves an extra step in arrow assembly.

SUMMARY OF THE INVENTION

According to the invention, the advantages of using a standard nock with close friction fit mounting shank so that the nock can be easily rotated for fine alignment with the fletching and can be removed and replaced when desired is maintained without the use of a bushing by reducing the inside diameter of the rear portion of the arrow shaft to the diameter needed to receive and tightly hold the nock, i.e., to the inside diameter substantially equal to that of the normally used bushing. In this way, the bushing, along with the extra weight added by the bushing, is eliminated.

With the invention, the rearward end of a hollow arrow shaft is swaged or otherwise formed to reduce preferably both the outside diameter and inside diameter of the arrow shaft and in all cases to reduce the inside diameter of the arrow shaft with the inside diameter being reduced to the inside diameter necessary to frictionally receive and hold the mounting shank of a standard nock. Reducing both the inside and outside diameters provide the added benefit of a substantially smooth transition between the normal arrow outside diameter to the reduced outside diameter at the rear of the arrow which has been found to better clear the arrow rest during shooting of the arrow and to improve aerodynamic flow over the arrow and reduce drag and wind effects on the arrow during flight for better shooting accuracy.

THE DRAWINGS

The best mode presently contemplated for carrying out the invention is illustrated in the accompanying drawings, in which:

FIG. 1 is a fragmentary side elevation of an archery arrow shaft of the invention showing the rear portion of the arrow shaft and fletching and showing a standard nock inserted into the rearward end of the shaft;

FIG. 2, a horizontal section taken on the line 2—2 of FIG. 1;

FIG. 3, a view similar to that of FIG. 2, but showing the nock partially removed from the arrow shaft; and FIG. 4, an exploded view of the rearward end of an arrow shaft of the invention and a standard nock to be inserted into the arrow shaft.

DETAILED DESCRIPTION OF THE ILLUSTRATED EMBODIMENT

As shown in the figures, a hollow archery arrow shaft 10 of the invention, such as made of aluminum tubing as is common, has a forward end, not shown, to which an arrow point, such as a hunting broadhead or a target or field point is attached in normal manner and a rearward end portion 11 to which a standard nock 12 can be attached. Fletching or vanes 13 are attached in normal manner to the arrow shaft adjacent the rearward end portion 11.

Figure 1:
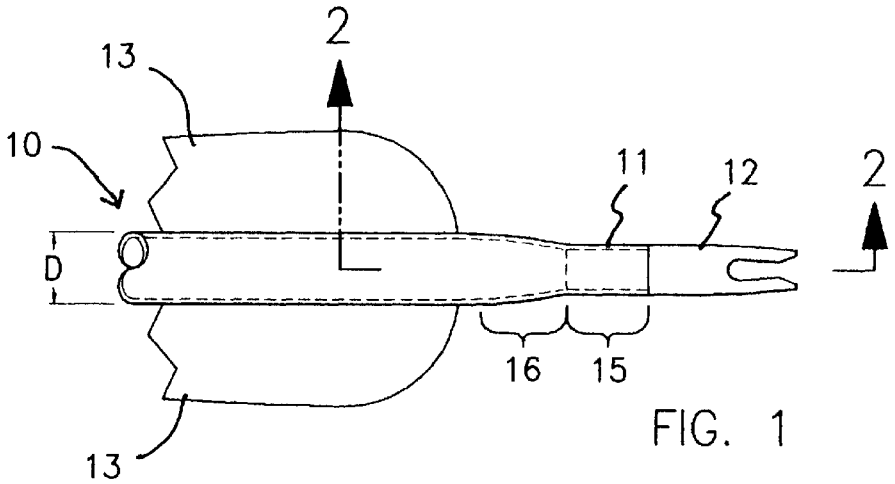
Figure 2:
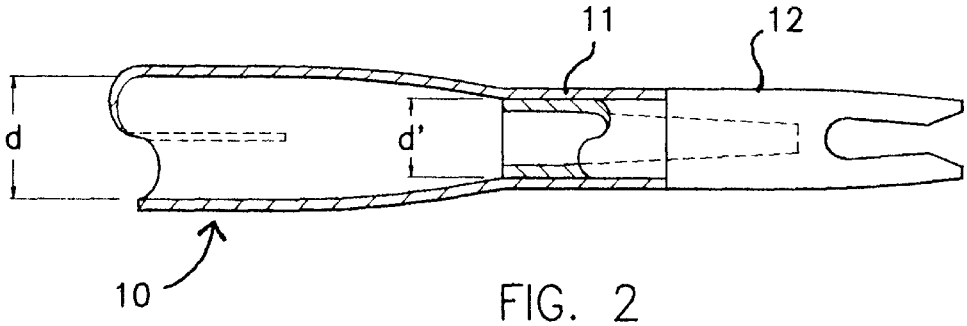
Figure 3:
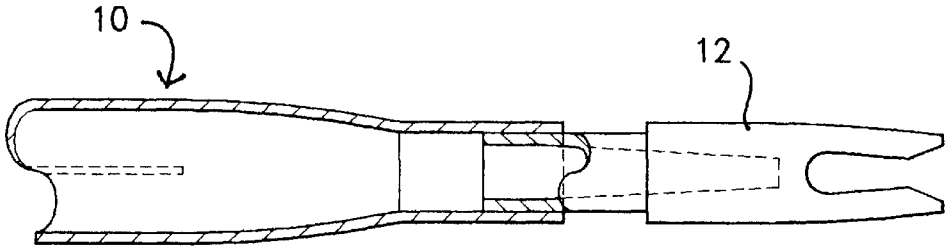

The arrow shaft 10 has a normal outside diameter "D", FIG. 1, and a normal inside diameter "d", FIG. 2. These diameters extend along the entire length of the arrow shaft 10 forwardly of the rearward end portion 11. The normal outside and inside diameter vary with different arrow shafts and the normal inside diameter is generally larger than the outside diameter of a mounting shank 14 extending from the forward end of a standard nock 12.

Figure 4:
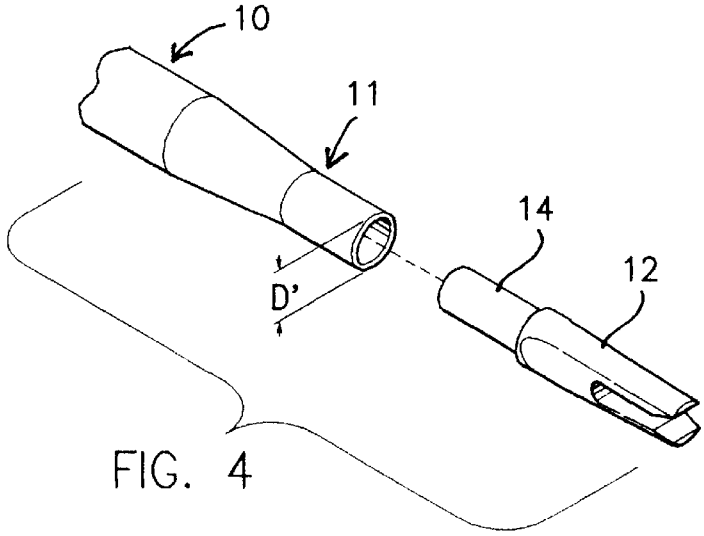

In prior art arrow shafts, the normal inside and outside diameters extend the entire length of the arrow shaft. However, in the arrow shaft of the invention, as illustrated, the rearward end portion 11 of the arrow shaft has a reduced outside diameter, "D'", FIG. 4, and a reduced inside diameter "d'", FIG. 2. The reduced inside diameter "d'" is substantially equal to the outside diameter of nock mounting shank 14 so as to provide a tight friction fit for the nock mounting shank 14 when inserted into rearward end portion 11 of the arrow. The fit is similar to that provided by the bushing as shown in the cited Bickel patent. The friction fit allows the nock to be rotated in the end of the arrow so it can be aligned as desired with the arrow fletching or can be removed and replaced. This can be done instantly since no adhesives are involved. In many instances, the mounting shank 14 of nock 12 is provided with ridges or lands (not shown) which ensure a tight friction fit of the shank in the reduced diameter portion (or in the bushing of the prior art) despite manufacturing tolerances for the reduced diameter portion of the arrow shaft (or bushing) and the nock. It should be noted here that by eliminating the bushing, one set of tolerances is eliminated. Thus, the tolerances involved are the inside diameter and alignment of the rearward reduced diameter portion of the shaft and the tolerance of the nock mounting shank. The tolerance of the fit between the bushing and the arrow shaft is not an added factor as it is when using the bushing. Therefore, stacking of the tolerances is reduced. Also, this provides better positioning and alignment of the nock in the arrow since alignment of the bushing is not a factor.

As shown, it is presently preferred that the reduced inside diameter portion 15, FIG. 1, of the rearward end portion of the arrow shaft extend a length about equal to the length of nock mounting shank 14. This provides improved rigidity to the end of the arrow shaft and to the nock mounted therein. It also provides better alignment between the nock and shaft and less flexing and deformation between the nock and shaft. This, along with the more accurate alignment, improves accuracy in shooting the arrow. However, such length is not necessary and shorter or longer lengths could be used. Generally, the currently used bushings are somewhat shorter than the length of the mounting shank 14.

The rearward end portion 11 of the arrow shaft 10 includes a transition portion 16 wherein the normal diameters are preferably smoothly reduced or tapered to the reduced diameters. This smooth transition is presently preferred for both aesthetic reasons and because a smooth transition from the normal outside diameter passes more smoothly over an arrow rest during shooting of the arrow to provide better shooting accuracy and repeatability. It also improves aerodynamic flow over the arrow and reduces drag and the impact of wind on arrow flight. This also improves shooting accuracy.

It has been found that a metal swaging process works well with aluminum arrow shafts to neck down the end of the shaft to the reduced diameter portion. Reaming of the end portion to the desired inside diameter increases accuracy and alignment of the bore. This would also work for the aluminum arrow shafts which serve as the basis for an aluminum-carbon arrow. With carbon arrows, a molding process can be used to create the end portion.

The elimination of the bushing used with a hollow arrow shaft reduces the weight of the arrow. A bushing can weight fifteen grains or more which is significantly more than just the thin walled aluminum used for the rearward end portion of the shaft, which can weigh up to about five grain. With a reduction in the weight at the rearward end of the arrow, to keep the balance point of the arrow the same, an equal amount of weight is reduced from the forward end of the arrow. Thus, the total weight of the arrow can be reduced to the extent of double the weight saving at the rearward end. Total arrow weight reduction of between ten and thirty-four grains have been achieved with the arrow configuration of the invention which eliminates the bushing. The reduced arrow weight gives a higher velocity of the arrow when shot from a bow which improves accuracy and reduces the impact of range estimation errors. It is presently preferred for weight reduction, that the wall thickness remain about the same throughout the total length of the arrow shaft, i.e., it does not get substantially thicker in the rearward end portion of the shaft.

While the currently used bushings are generally made of aluminum alloy as are the arrow shafts, the alloys used are different. Thus, elimination of the bushing removes the possibility of corrosion caused by dissimilar metals in contact with one another.

It should be noted that the important aspect of the invention is the integral nature of the reduced diameter rearward portion of the arrow shaft so that it is an integral part of the arrow shaft and is not a separate insert as is the bushing it replaces.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A hollow, elongate arrow shaft having a normal outside diameter and a normal inside diameter creating a central bore therethrough, said normal inside diameter being larger than the outside diameter of a mounting shank of a nock to be mounted in the rearward end of the arrow shaft, and said arrow shaft having an integral rearward end portion having a reduced outside diameter and reduced inside diameter, said reduced inside diameter being less than the normal inside diameter and of a size to frictionally engage and hold the mounting shank of the nock to be mounted in the rearward end of the shaft to thereby allow mounting of the nock to the rearward end of the arrow shaft, and the arrow shaft being of the normal outside diameter over substantially its entire length except for the rearward end portion of reduced outside diameter.

2. A hollow, elongate arrow shaft according to claim 1, wherein the reduced inside diameter of the rearward end portion extends for a distance substantially equal to the length of the mounting shank of the nock to be mounted.

3. A hollow, elongate arrow shaft according to claim 2, wherein the rearward end portion includes a transition portion between the normal diameters and the reduced diameters.

4. A hollow, elongate arrow shaft according to claim 3, wherein the transition portion creates a smooth tapered transition between the normal diameters and the reduced diameters.

5. A hollow, elongate arrow shaft according to claim 1, wherein the rearward end portion includes a transition portion between the normal diameters and the reduced diameters.

6. A hollow, elongate arrow shaft according to claim 5, wherein the transition portion creates a smooth tapered transition between the normal diameters and the reduced diameters.

7. A hollow, elongate arrow shaft according to claim 1, wherein the arrow shaft is an aluminum arrow shaft and the rearward end portion is formed by swaging the end portion of the aluminum shaft.

8. A hollow, elongate arrow shaft according to claim 7, wherein the rearward end portion includes a transition portion between the normal diameters and the reduced diameters.

9. A hollow, elongate arrow shaft according to claim 8, wherein the transition portion creates a smooth tapered transition between the normal diameters and the reduced diameters.

10. A hollow, elongate arrow shaft having a normal inside diameter creating a central bore therethrough, said normal inside diameter being larger than the outside diameter of a mounting shank of a nock to be mounted in the rearward end of the arrow shaft, and said arrow shaft having an integral rearward end portion having a reduced inside diameter, said reduced inside diameter being less than the normal inside diameter and of a size to frictionally engage and hold the mounting shank of the nock to be mounted in the rearward end of the shaft to thereby allow mounting of the nock to the rearward end of the arrow shaft, and the arrow shaft being of a substantially constant outside diameter over at least substantially its entire length except for the rearward end portion of reduced inside diameter.

11. A hollow, elongate arrow shaft having a normal outside diameter and a normal inside diameter creating a central bore therethrough, said normal inside diameter being larger than the outside diameter of a mounting shank of a nock to be mounted in the rearward end of the arrow shaft, and said arrow shaft having an integral rearward end portion having a reduced outside diameter and reduced inside diameter, said reduced inside diameter being less than the normal inside diameter and of a size to frictionally engage and hold the mounting shank of the nock to be mounted in the rearward end of the shaft to thereby allow mounting of the nock to the rearward end of the arrow shaft, said reduced inside diameter of the rearward end portion extending for a distance substantially equal to the length of the mounting shank of the nock to be mounted.

12. A hollow, elongate arrow shaft according to claim 11, wherein the rearward end portion includes a transition portion between the normal diameters and the reduced diameters.

13. A hollow, elongate arrow shaft according to claim 12, wherein the transition portion creates a smooth tapered transition between the normal diameters and the reduced diameters.

14. A hollow, elongate arrow shaft having a normal inside diameter creating a central bore therethrough, said normal inside diameter being larger than the outside diameter of a mounting shank of a nock to be mounted in the rearward end of the arrow shaft, and said arrow shaft having an integral rearward end portion having a reduced inside diameter, said reduced inside diameter being less than the normal inside diameter and being substantially equal to the outside diameter of the mounting shank of the nock to be mounted in the rearward end of the shaft to thereby allow mounting of the nock to the rearward end of the arrow shaft, and the arrow shaft being of a substantially constant outside diameter over at least substantially its entire length except for the rearward end portion of reduced inside diameter.

* * * * *